United States Patent [19]

Heberle et al.

[11] Patent Number: 4,869,211

[45] Date of Patent: Sep. 26, 1989

[54] LUBRICATING OIL CHANNEL

[75] Inventors: Hansjörg Heberle, Bodman-Ludwigsburg; Werner Leicht, Stetten, both of Fed. Rep. of Germany

[73] Assignee: MTU-Motoren und Turbinen-Union, Friedrickshafen, Fed. Rep. of Germany

[21] Appl. No.: 236,229

[22] PCT Filed: Nov. 20, 1987

[86] PCT No.: PCT/DE87/00534

§ 371 Date: Jul. 6, 1988

§ 102(e) Date: Jul. 6, 1988

[87] PCT Pub. No.: WO88/05860

PCT Pub. Date: Aug. 11, 1988

[30] Foreign Application Priority Data

Feb. 3, 1987 [DE] Fed. Rep. of Germany ..... 3703047

[51] Int. Cl.[4] ..... F01P 1/04; F01M 1/00; F16N 1/00

[52] U.S. Cl. ..... 123/41.35; 123/196 R; 184/24

[58] Field of Search ..... 123/41.35, 196 R, 196 M; 184/24, 6.5; 92/153

[56] References Cited

U.S. PATENT DOCUMENTS 3,485,324 12/1969 Novak ..... 123/96 R

FOREIGN PATENT DOCUMENTS 844990 5/1952 Fed. Rep. of Germany .
968013 12/1957 Fed. Rep. of Germany .
2061342 6/1972 Fed. Rep. of Germany ... 123/41.35
2095745 1/1972 France .

*Primary Examiner*—Henry A. Bennet
*Assistant Examiner*—Denise L. Ferensic
*Attorney, Agent, or Firm*—Barnes & Thornburg

[57] ABSTRACT

The invention relates to the construction of a lubricating oil channel (12), by way of which lubricating oil is conducted to spray nozzles (2) for the cooling of the pistons of an internal combustion engine. The spray nozzles (2) are connected with spray nozzle holders (3) that are secured at cross walls (4) in the crankcase (5). Passages (7) formed-in into the spray nozzle holders (3) which adjoin through-bores (9) in the cross walls (4). Plug-in pipes (10) are arranged between the passages (7) of two mutually oppositely disposed spray nozzle holders (3) secured at different cross walls (4) which complete the lubricating oil channel. A simple and cost-favorably representable lubricating oil channel is indicated therewith. A particular advantage is that the components of the lubricating oil channel are finish-machined prior to the installation and thus contaminations by machining residues are controllable prior to the installation. The lubricating oil channel is adapted to be laid out space-savingly in the crankcase (5) and again disassemblable for servicing.

4 Claims, 3 Drawing Sheets

LUBRICATING OIL CHANNEL

Figure 1:
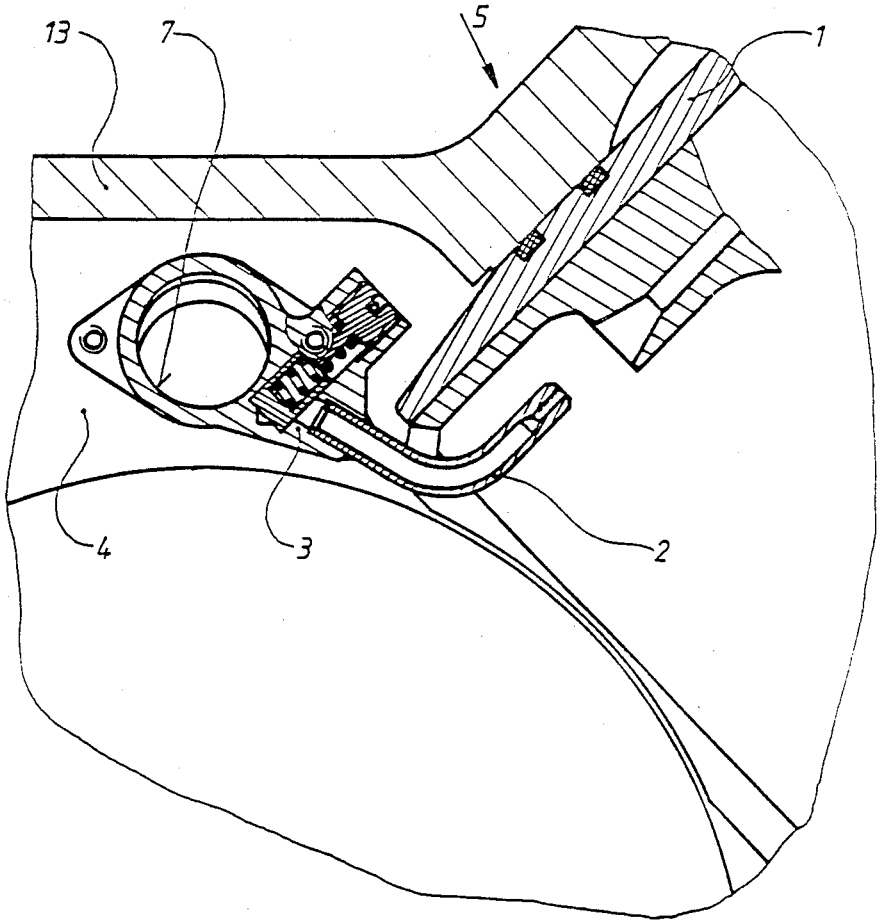

The present invention relates to a lubricating oil channel according to the preamble of the claim 1, as is known for example from the DE-PS No. 968 013.

An internal combustion engine is illustrated in the DE-PS No. 968 013, whose pistons are cooled by spraying with lubricating oil by means of spray nozzles. The feed of the lubricating oil to the spray nozzles takes place by way of a lubricating oil channel which leads past in proximity of the open ends of the cylinder liners protruding into the crankcase. The spray nozzles are mounted under interposition of fitting pieces serving as holders on the outer circumference of the pipe-shaped constructed lubricating oil channel. In order that lubricating oil reaches the nozzle, the lubricating oil channel includes circumferential bores which adjoin at passages in the holders. A longitudinal bore in a cast piece extending in the engine longitudinal direction apparently serves as lubricating oil channel which appears to be cast-on at the crankcase. The fastening of the spray nozzles at the lubricating oil channel apparently takes place by means of a bolt each which seizes a spray nozzle holder from below and is screwed into a thread in the wall of the lubricating oil channel. This makes it necessary to keep the wall thickness of the lubricating oil channel so large that a sufficient depth of the thread for a sufficient holding of the fastening bolts is provided. With a cast-in lubricating oil channel, cutting machining-operations become necessary in the crankcase space.

By reason of control measures difficult to carry out in the crank space, it cannot be precluded that machining left-overs such as shavings remain in the lubricating oil channel or elsewhere in the crank space.

According to the DE-PS No. 844 990 the lubricant line is assembled of pipe sections and T-shaped connecting sections. The lubricating oil is not conducted to the pistons of the internal combustion engine by means of spray nozzles but instead by way of a sealed line connection by means of telescopic pipes. One outlet of each T-shaped connecting section therefore is in communication with a telescopic pipe. However, it is not illustrated how the lubricant line assembled in this manner is guided and secured in the crankcase. However, as no mountings are illustrated at the connecting sections, it must be assumed that the pipe sections disposed between the connecting sections are retained in some manner.

The invention is concerned with the task to indicate construction and arrangement of a lubricating oil channel which can be represented and varied in a simple and cost-favorable manner, can be laid out space-savingly in the crankcase, is readily accessible and also again disassemblable together with spray nozzles, and whereby it is assured also in particular that contaminations of the lubricating oil channel by shavings or other machining residues are precluded.

This task is solved with an arrangement of the aforementioned type by the characterizing features of the claim 1.

The particular construction of the spray nozzle holder, namely, that they can be attached at the cross walls of the crankcase, that they possess passages which adjoin the through-bores in the cross walls, and that they serve at the same time for holding the plug-in pipes which complete the lubricating oil channel, enables the simple and cost-favorable construction of a lubricating oil line in the crank space.

As the individual components of the lubricating oil channel are finish-machined prior to the installation and are controllable outside of the crank space as regards machining residues, a contamination of the lubricating oil channel is precluded. The principle of construction of the lubricating oil channel enables to lay-out the lubricating oil lines space-savingly at any desired place in the crankcase. For a space-saving arrangement, the lubricating oil line can be adapted to all special conditions in different crankcase constructions especially by means of only slight component changes. Thus, in a particular construction with an internal combustion engine having V-shaped arranged cylinders, the lubricating oil channel is laid out barely below a boundary wall of a crankcase in order to achieve as low as possible a structural height of the internal combustion engine. For strength reasons—the through-bores in the cross walls are to be located as far as possible away from highly stressed critical transition areas between cross wall and upper boundary wall of the crankcase—and for reasons of the accessibility the through-bores must be located lower than can be located for the other sections of the lubricating oil line in consideration of the envelope described by the connecting rod as it moves with the crankshaft and of the most space-saving type of construction. The type of construction of the lubricating oil channel permits an adaptation to the spatial conditions in a simple manner in that more particularly through-bores and plug-in pipes are arranged offset. The offset is established by a suitably extending formed-in passage in the spray nozzle holder.

Figure 2:
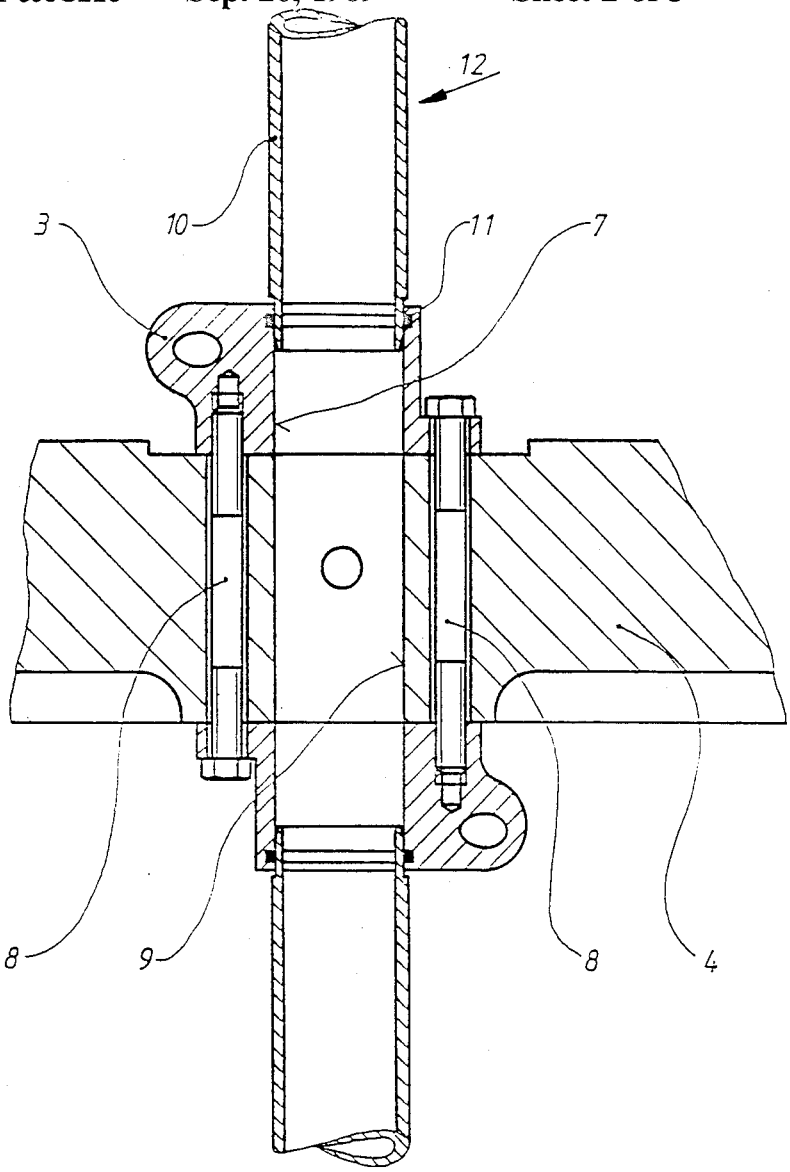
Figure 3:
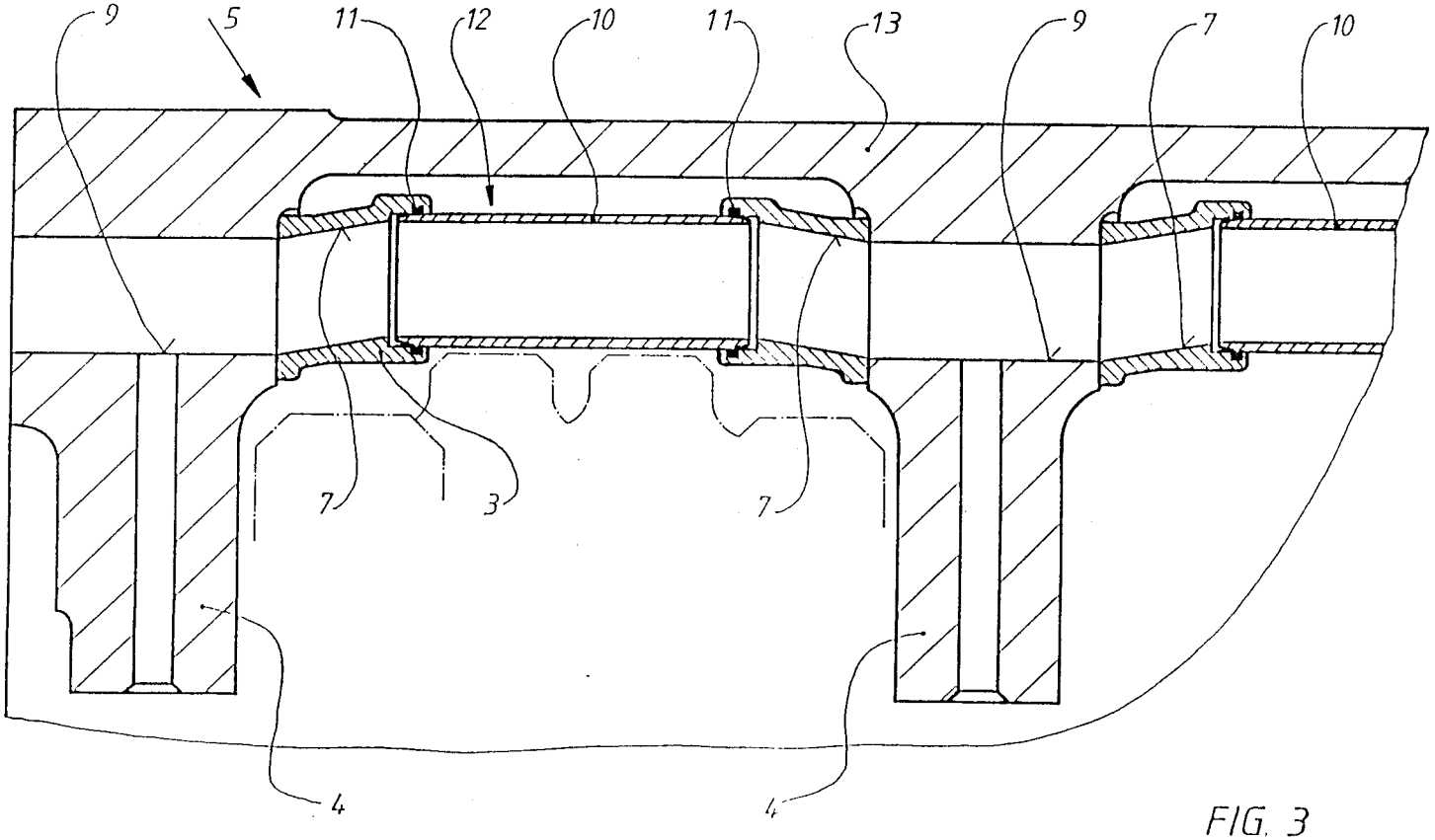

One embodiment of the invention is illustrated in the drawings and will be described more fully hereinafter; there is shown:

FIG. 1 a fragmentary cross-sectional view of the crank space of an internal combustion engine within the area of a spray nozzle with a view on a cross wall of the crankcase, FIG. 2 a cross section through a cross wall of the crankcase in the area of the passage holes and the fastening of the spray nozzle holder, FIG. 3 the layout of a section of a lubricating oil channel within the area between two cross walls of the crankcase.

The cylinders are arranged V-shaped in the internal combustion engine whose crank space is illustrated in a fragmentary cross-sectional view. The area of the crank space is illustrated in which the lower end of a cylinder liner 1 is arranged. A spray nozzle 2 with spray nozzle holder 3 is coordinated to the cylinder liner 1 whereby the spray nozzle holder is secured on a cross wall 4 of the crankcase 5. The cross wall 4 is connected with an upper boundary wall 13 of the crankcase 5. Non-illustrated crankshaft bearings are arranged in the cross walls 4. The spray nozzle holders 3 are located above the crankshaft bearings in the center line of the internal combustion engine. The lubricating oil channel 12 thus lies centrally between the two cylinder rows of the internal combustion engine.

The fastening of two spray nozzle holders 3 disposed mutually opposite on different sides of a cross wall 4 is illustrated in FIG. 2. In order to avoid that threads must be cut into the cross wall 4, which is unfavorable in particular with aluminum crankcases, the spray nozzle holders 3 are arranged rotated by 180° with respect to one another. The two fastening bolts 8 are each screwed from different sides into the thread in the respectively oppositely disposed spray nozzle holder 3. As a through-hole and a dead-end hole exist in each spray nozzle holder, the advantage is also achieved that an incorrect assembly is precluded. The fastening bolts 8 are additionally so long that by reason of a sufficient elastic prestress an additional bolt-securing can be dispensed with. Passages 7 are formed-in into the spray nozzle holders 3 which adjoin the through-bores 9 in the cross walls 4. Plug-in pipes 10 are inserted into the passages 7 of the spray nozzle holders 3 which complete the lubricating oil channel 12. Sealing rings 11 serve for sealing purposes which are located between plug-in pipe 10 and passage 7.

A section of a lubricating oil channel 12 assembled of plug-in pipes 10, spray nozzle holders 3 and through-bores 9 is illustrated in FIG. 3 which shows a fragmentary longitudinal cross section of the crankcase within the area between two cross walls 4. It becomes clear that the plug-in pipes 10 are retained completely at the spray nozzle holders 3. For purposes of installation between the two cross walls 4, a lubricating oil channel section assembled of plug-in pipe 10 and two spray nozzle holders 3 is placed into the crankcase 5 and the fastening bolts 8 are screwed-in. In a similarly simple manner, for example, with soiled spray nozzles, parts of the oil channel together with spray nozzles or the entire oil channel can also be again disassembled and exchanged.

The contour of the envelope described by the connecting rod as it moves with the crankshaft is illustrated in dash and dotted lines between the cross walls 4 which also contain bores by way of which the lubricating oil reaches the crankshaft bearings. The arrangement of the lubricating oil channel barely below the upper boundary wall 13 permits a compact type of construction of the engine in which only a narrow space exists between upper boundary wall 13 of the crankcase 5 and the power plant parts rotating with the crankshaft. For strength reasons and for reasons of the accessibility, the through-bores in the cross walls cannot be located too close to the critical transition area between cross wall and upper boundary wall of the crankcase. By reason of the type of construction of the lubricating oil channel, the through-bores can be located lower in the cross walls than the plug-in pipes 10. A corresponding configuration of the passages in the spray nozzle holders 3 which adjoin the through-bores in the cross walls, is then necessary. The passages are then so shaped that an offset results. The passages then extend then obliquely toward the upper boundary wall. In this manner, the lubricating oil channel can be constructed in the most space-saving manner of construction without having to accept other disadvantages.

We claim:

1. A lubricating oil channel for feeding lubricating oil to spray nozzle means which serve for cooling pistons of an internal combustion engine having a crankcase, said spray nozzle means being connected with said spray nozzle holder means, a passage for the flow of lubricating oil from the lubricating oil channel to the spray nozzle means being provided in the spray nozzle holder means, the spray nozzle holder means being secured at cross walls of the crankcase for the crankshaft bearing support, pipe-shaped passages being formed into the spray nozzle holder means which adjoin through-bores of the cross walls, and the passages of two spray nozzle holder means arranged at different cross walls and disposed mutually opposite one another being connected by plug-in pipe means.

2. A lubricating oil channel according to claim 1, wherein the spray nozzle holder means located on different sides of the same cross wall are threadably secured by means of common fastening bolts passing through the cross wall.

3. A lubricating oil channel according to claim 2, wherein the through-bores in the cross walls are arranged offset with respect to the plug-in pipe means, and wherein a transition following the offset is formed into the passages of the spray nozzle holder means.

4. A lubricating oil channel according to claim 1, wherein the through-bores in the cross walls are arranged offset with respect to the plug-in pipe means, and wherein a transition following the offset is formed into the passages of the spray nozzle holder means.

* * * * *